United States Patent [19]

Behlert

[11] 4,211,026

[45] Jul. 8, 1980

[54] CENTER PIN LOCK FOR SINGLE-ACTION REVOLVER

[76] Inventor: Austin F. Behlert, 33 Herning Ave., Cranford, N.J. 07016

[21] Appl. No.: 947,628

[22] Filed: Oct. 2, 1978

[51] Int. Cl.[2] ..... F41C 1/00

[52] U.S. Cl. ..... 42/59

[58] Field of Search ..... 42/59

[56] References Cited

U.S. PATENT DOCUMENTS

| | | | |
|---|---|---|---|
| 165,369 | 7/1875 | Rupertus | 42/59 |
| 444,823 | 1/1891 | Foehl et al. | 42/59 |
| 453,421 | 6/1891 | Caldwell | 42/59 |
| 954,191 | 4/1910 | Kolb | 42/59 |
| 2,955,373 | 10/1960 | Ruger | 42/59 |
| 3,613,285 | 10/1971 | Kennedy | 42/59 |

*Primary Examiner*—Charles T. Jordan

*Attorney, Agent, or Firm*—Lerner, David, Littenberg & Samuel

[57] ABSTRACT

A single-action revolver is disclosed which includes a cylinder frame and a cylinder to be mounted in the cylinder frame and a barrel removably connected to the cylinder frame. A center pin extends through the cylinder frame for rotatably mounting the cylinder within the cylinder frame, and a release plunger is provided for retaining the center pin in engagement with the cylinder frame in a conventional manner. The improvement is directed to interlocking means for retaining the center pin in engagement with the cylinder frame and includes a slot formed in the barrel and a collar formed on the center pin for engagement with the barrel slot to prevent release of the center pin. In addition, the center pin includes an additional notch for receiving the release plunger when the collar is rotated into engagement with the barrel slot. In this manner, the interlocking means prevent the center pin from being jolted loose during firing of the revolver.

9 Claims, 5 Drawing Figures

CENTER PIN LOCK FOR SINGLE-ACTION REVOLVER

FIELD OF THE INVENTION

The present invention relates generally to single-action revolvers and specifically to an improved locking mechanism for the center pin on which the cylinder is rotatably mounted to prevent the center pin from being jolted loose during firing of the revolver.

BACKGROUND OF THE INVENTION

Single-action revolvers typically include a cylinder rotatably mounted on a center pin. For many years, the cylinder frame of the coventional single-action revolver has included a spring-biased release plunger for maintaining the center pin in engagement with the cylinder frame and cylinder.

However, the release plunger has not been completely satisfactory in maintaining the center pin in proper position during repeated firing of the revolver. It has been experienced that after repeated firing of the revolver, the repeated recoil action causes the spring of the release plunger to be compressed and thereby release the center pin from engagement with the cylinder frame. This problem may partially be avoided if the notch of the center pin which the release plunger engages was made slightly deeper. However, this would create the additional problem of substantially weakening the center pin and is therefore not an acceptable solution to the problem.

Broadly, it is an object of the present invention to provide an improved locking mechanism which overcomes the aforesaid problem. Specifically, it is within the contemplation of the present invention to provide an interlocking mechanism which interlocks the center pin with the barrel in a positive manner to prevent the center pin from being jolted out of proper position during repeated firing and recoil of the revolver.

It is a further object of the present invention to provide a double-locking mechanism for the center pin so that when one locking mechanism is in engagement with the barrel, the release plunger is in engagement with a notch which has been added to the center pin to form a second locking mechanism which operates to prevent rotation of the center pin when the cylinder is rotated or when the revolver is fired.

SUMMARY OF THE INVENTION

Briefly, in accordance with the principles of the present invention, an improved locking mechanism for the center pin of a single-action revolver is provided. The revolver includes a cylinder rotatably mounted on the center pin. In a conventional manner, the spring-biased release plunger of the cylinder frame engages a notch formed in the center pin to prevent rotation of the center pin when the cylinder is rotated. Although this release plunger has been employed in the past to maintain the center pin from being axially moved out of position, this has not been completely satisfactory.

Accordingly, in order to prevent the center pin from being axially jolted out of position during repeated firing of the revolver, an improved interlocking mechanism is provided which includes a slot formed in the barrel and a collar formed on the center pin for engagement with the barrel slot. The engagement of the collar and barrel slot acts as a lock or stop to prevent axial movement of the center pin relative to the cylinder frame and barrel. The collar of the center pin is moved into and out of engagement with the barrel slot by rotating the center pin 180°. As a result, the release plunger is moved out of engagement with the conventional notch of the center pin when the center pin is rotated 180°. Accordingly, a second notch has been formed in the center pin for engaging the release plunger when the collar is rotated into engagement with the barrel slot. Preferably, the notches are formed in the surface of the center pin approximately 180° apart from each other.

Advantageously, as a result of the present invention, a double-locking mechanism is provided for removably retaining the center pin in proper engagement with the cylinder and cylinder frame. The rotation of the collar into engagement with the barrel slot provides a positive locking mechanism to prevent axial movement of the center pin. In addition, by providing a second notch in the center pin, it is brought into engagement with the conventional release plunger and provides a second locking mechanism for preventing rotation of the center pin, especially when the cylinder is rotated. In this manner, as the release plunger and notch prevent rotation of the center pin, the collar of the center pin cannot be rotated out of engagement with the barrel slot. Accordingly, the two locking mechanisms cooperate with each other to prevent axial or rotational movement of the center pin during repeated firing and recoil of the revolver.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
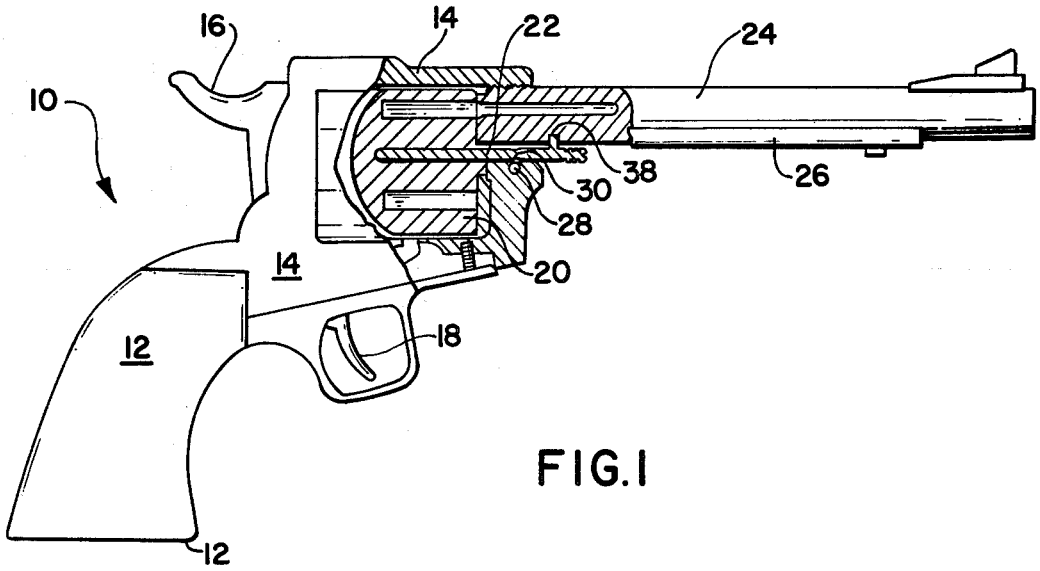
FIG. 1 is a side view of a single-action revolver, partially broken away to illustrate in cross section the center pin in locking relation with the barrel and cylinder frame.

Referring now to FIG. 1, there is shown the improved single-action revolver of the present invention, generally designated by the reference numeral 10, which includes the following conventional components: a handle grip and frame 12 connected to a cylinder frame 14; a hammer assembly 16; a trigger assembly 18; a cylinder 20 rotatably mounted on center pin 22 within cylinder frame 14; a barrel 24 threadedly connected to cylinder frame 14; an ejector housing 26 on barrel 24; and a center pin release plunger 28 mounted on cylinder frame 14 for engagement within a notch 30 formed in the surface of center pin 22. As shown in greater detail in FIG. 3, the release plunger 28 is spring biased by spring 31 so that when center pin 22 is pushed all the way into its proper position within cylinder 20, the plunger 28 can move relative to notch 30, and the plunger is forced to do so by spring 31. The foregoing elements and their cooperative working relationship are well known in the art and need not be described in further detail for an understanding of the present invention.

Figure 4:
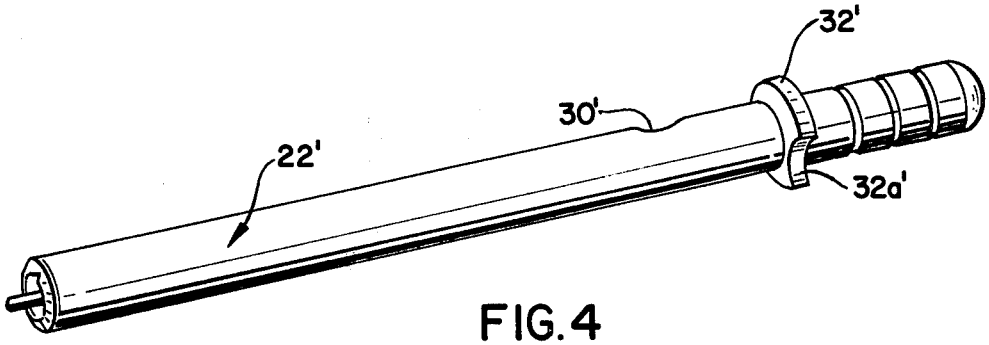
FIG.4 PRIOR ART
FIG. 4 is an enlarged perspective view in detail of the center pin as employed in the prior art.

Referring to FIG. 4, the conventional prior art center pin 22' is shown. As explained above, the conventional prior art center pin 22' included a notch 30' for engaging the release plunger 28. In addition, a collar 32' was formed on the center pin and included a cutaway area **32*a'* which matched the circular periphery of the barrel 24 for engagement with the underside of the barrel while plunger 28 was in engagement with depression 30'**.

Figure 3:
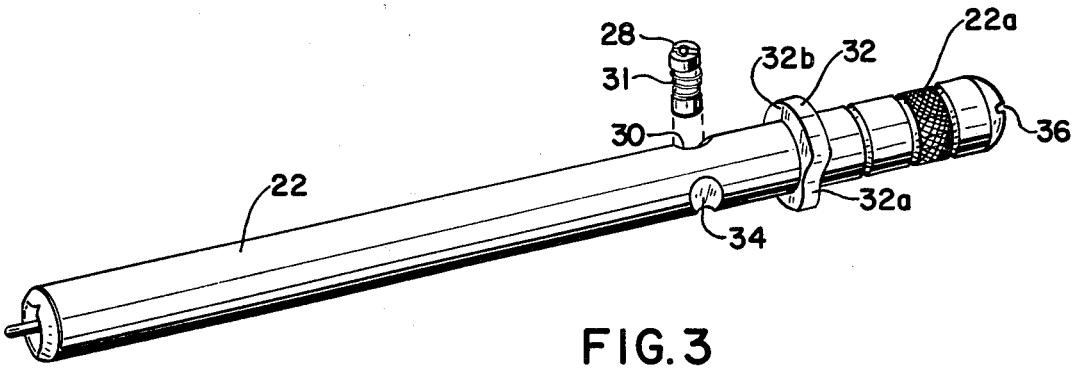
FIG. 3 is an enlarged perspective view in detail of the improved center pin of the present invention.
Figure 2:
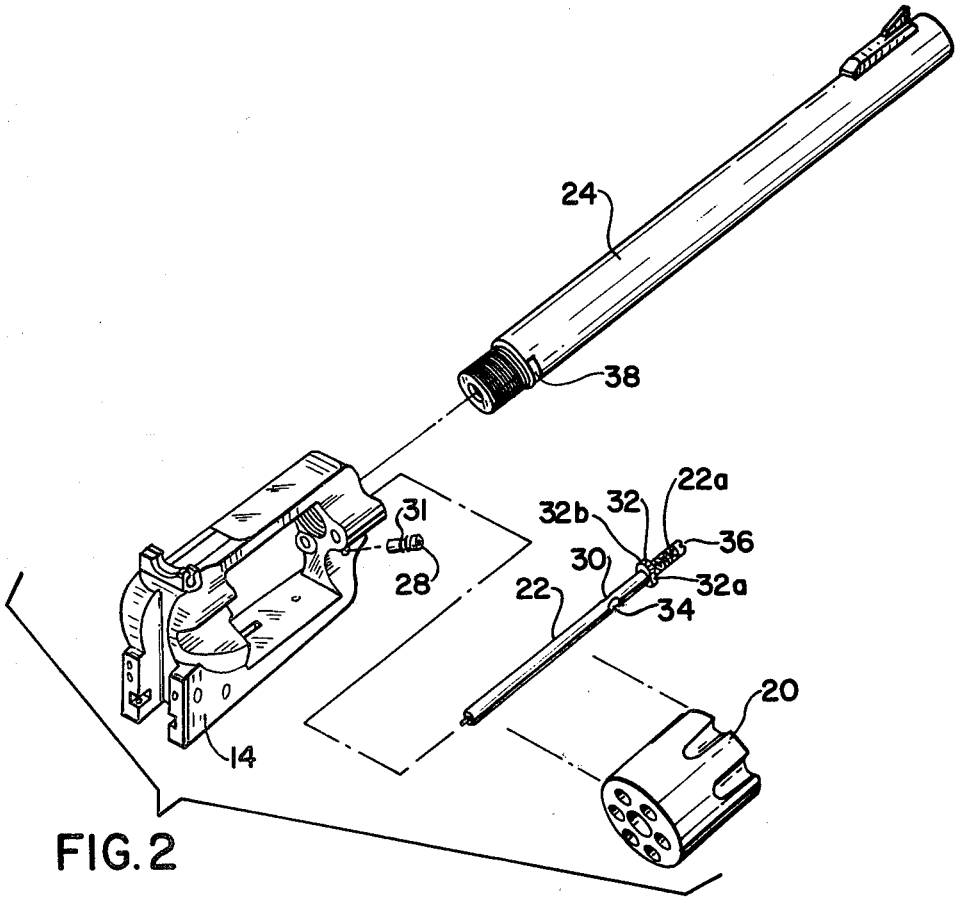
FIG. 2 is an exploded perspective view of the cylinder frame, cylinder, and novel center pin and barrel which cooperate to provide the locking mechanism of the present invention.
Figure 5:
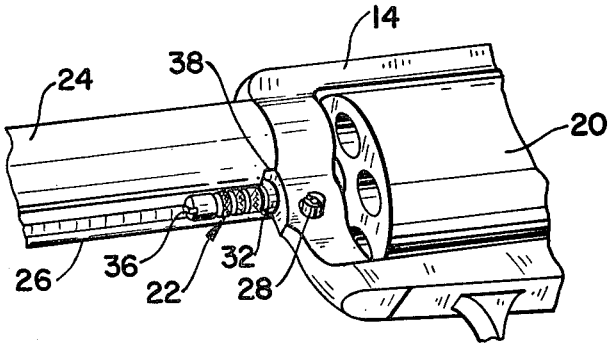
FIG. 5 is a partial perspective view of the center pin in its locked position.

In order to provide the improved locking arrangement of the present invention, the center pin 22 has been modified, as shown in FIG. 3. The center pin 22 not only includes notch 30 but, in accordance with the present invention, is provided with a second notch 34 for engaging plunger 28 when center pin 22 and collar 32 are rotated into the locking position, in manner to be explained. Also, in accordance with the present invention, cutaway area **32*a* has been designed so that surface 32*a* is now substantially flattened. In addition, in order to rotate center pin 22, a receiving slot 36 for a screwdriver has been formed in the end of center pin 22. Of course, any other suitable means for rotating the center pin and collar into locking position can be provided. For example, the area 22*a* of the center pin could be knurled. Finally, in accordance with the present invention, a slot 38 has been formed in the bottom half of barrel 24 adjacent the end of the barrel which engages the cylinder frame 14, which slot 38 is clearly shown in FIGS. 1 and 2**.

In order to operate the improved center pin lock of the present invention, center pin 22 is inserted through cylinder frame 14 and into cylinder 20 in the conventional manner. As a result, release plunger 28 cooperates with notch 30, also in the conventional manner. Then, center pin 22 is rotated approximately 180° by any suitable means, such as by a screwdriver inserted into slot 36 of the center pin. As a result, the substantially flat side **32*a* of collar 32 will be rotated away from barrel 24, and the enlarged portion 32*b* of collar 32 will be rotated into engagement with barrel slot 38. As a result, collar portion 32*b* in cooperative engagement with barrel slot 38 acts as a positive stop or lock to prevent axial movement of the center pin 22 out of engagement with cylinder frame 14 and cylinder 20. In addition, when center pin 22 is rotated 180°, the second notch 34 is brought into working engagement with release plunger 28. As a result, the cooperation of notch 34 and plunger 28 prevents rotation of the center pin 22 when the cylinder 20 is rotated and also when the revolver is fired. Thus, collar portion 32*b* of center pin 22 cannot be rotated out of engagement with barrel slot 38. Accordingly, it will be understood that as notch 34 and plunger 28 prevent rotation of the center pin, and as collar portion 32*b* and barrel slot 38 prevent axial movement of center pin 22, both of these locking mechanisms cooperate to prevent release of the center pin from proper engagement with cylinder frame 14 and cylinder 20**.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A single-action revolver comprising:

a frame including a cylinder frame and a cylinder to be mounted in said cylinder frame, and a barrel removably connected to said cylinder frame;

a center pin extending through said cylinder frame for rotatably mounting said cylinder within said cylinder frame;

first means for removably retaining said center pin in engagement with said cylinder frame;

and second means for removably retaining said center pin in engagement with said cylinder frame including means interlocking said center pin and said barrel.

2. The revolver of claim 1, wherein said interlocking means includes a slot formed in said barrel and a collar formed on said center pin for engagement with said barrel slot to prevent release of said center pin.

3. The revolver of claim 2, wherein said center pin includes a first notch for receiving said first retaining means and a second notch for receiving said first retaining means when said collar is rotated into engagement with said barrel slot.

4. The revolver of claim 3, wherein said first and second notches are formed in the surface of said center pin approximately 180° apart from each other.

5. The revolver of claims 2 or 3, wherein said barrel slot is formed in the bottom of said barrel and adjacent the end of said barrel connected to said cylinder frame.

6. The revolver of claim 2, wherein said center pin includes means for rotating said center pin and collar into engagement with said barrel slot.

7. The revolver of claim 6, wherein said rotating means is an instrument-receiving slot formed in the end of said center pin.

8. The revolver of claim 2, wherein one side of said collar is substantially flattened so that said center pin and said collar may be moved into and out of engagement with said barrel slot.

9. The revolver of claim 3, wherein said first retaining means includes a spring-biased release plunger having a depression which cooperates with said first and second notches of said center pin.

* * * * *